US007648448B2

(12) United States Patent
Krull

(10) Patent No.: US 7,648,448 B2
(45) **Date of Patent: *Jan. 19, 2010**

(54) WEIGHT SELECTION METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 0 days.

This patent is subject to a terminal disclaimer.

(21) Appl. No.: 12/214,322

(22) Filed: Jun. 17, 2008

(65) Prior Publication Data

US 2008/0254953 A1 Oct. 16, 2008

Related U.S. Application Data

(63) Continuation of application No. 11/652,950, filed on Jan. 12, 2007, now Pat. No. 7,387,597.

(60) Provisional application No. 60/759,998, filed on Jan. 17, 2006.

(51) Int. Cl.
*A63B 21/072* (2006.01)
*A63B 21/075* (2006.01)

(52) U.S. Cl. ..... 482/108; 482/107

(58) Field of Classification Search ..... 482/93, 482/106–109, 94–97

See application file for complete search history.

(56) References Cited

U.S. PATENT DOCUMENTS

| | | | | |
|---|---|---|---|---|
| 6,500,101 | B1 * | 12/2002 | Chen | 482/107 |
| 7,121,988 | B2 * | 10/2006 | Walkerdine | 482/106 |
| 7,261,678 | B2 * | 8/2007 | Crawford et al. | 482/107 |
| 7,387,597 | B2 * | 6/2008 | Krull | 482/108 |
| 2003/0148862 | A1 * | 8/2003 | Chen et al. | 482/108 |
| 2004/0072661 | A1 * | 4/2004 | Krull | 482/106 |
| 2006/0189458 | A1 * | 8/2006 | Walkerdine | 482/106 |

* cited by examiner

*Primary Examiner*—Fenn C Mathew

(57) ABSTRACT

An exercise dumbbell includes a handle member and weight plates maintained in spaced relationship at opposite ends thereof. Knobs on the handle member have contoured bearing surfaces that bear against respective selector members to alternatively hold the selector members in weight engaging positions and disengaged positions.

19 Claims, 8 Drawing Sheets

FIG. 7A
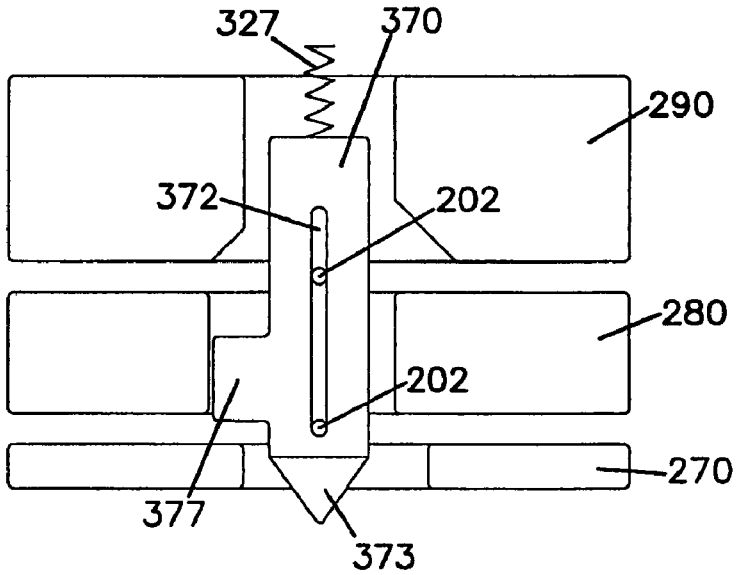
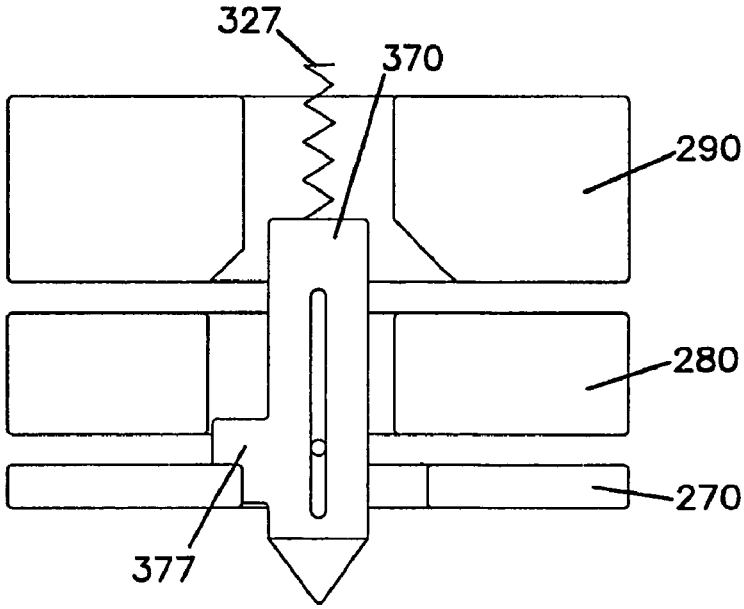
FIG. 7B

FIG. 8A
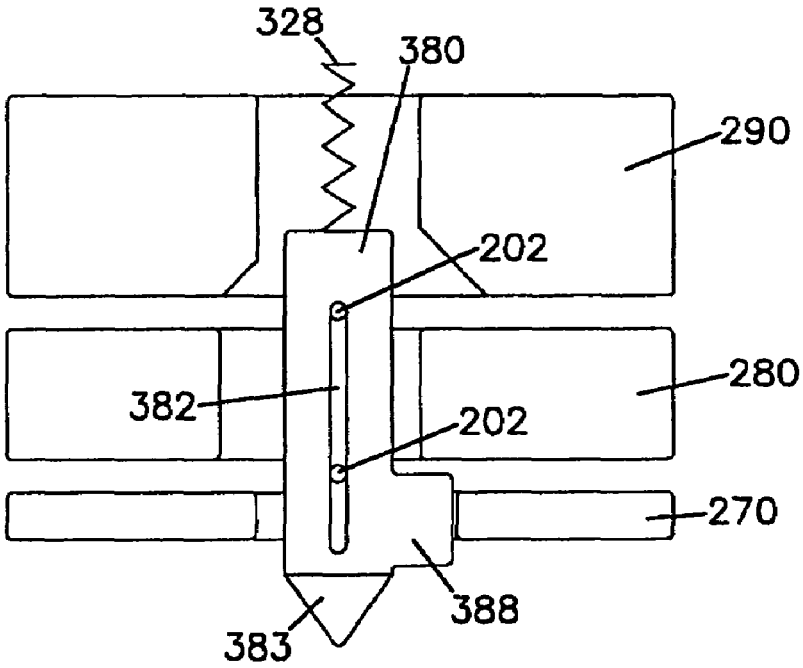
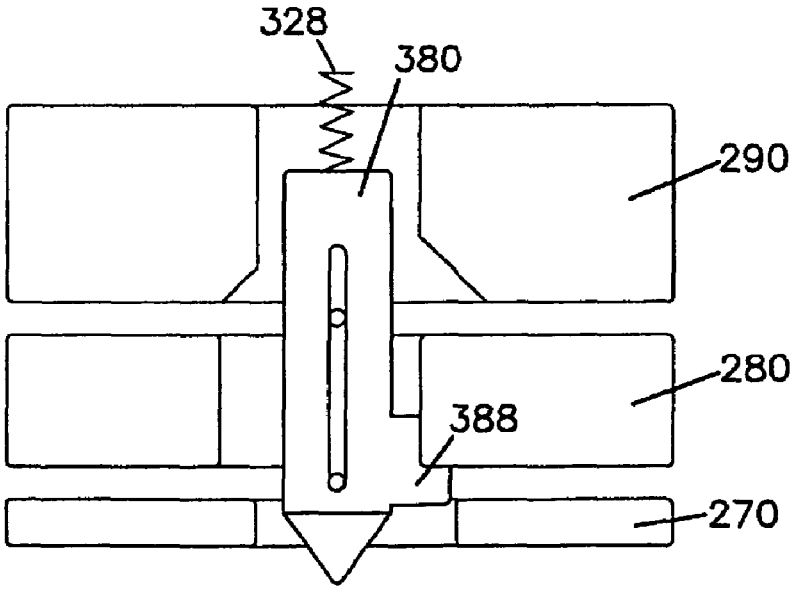
FIG. 8B

FIG. 9A
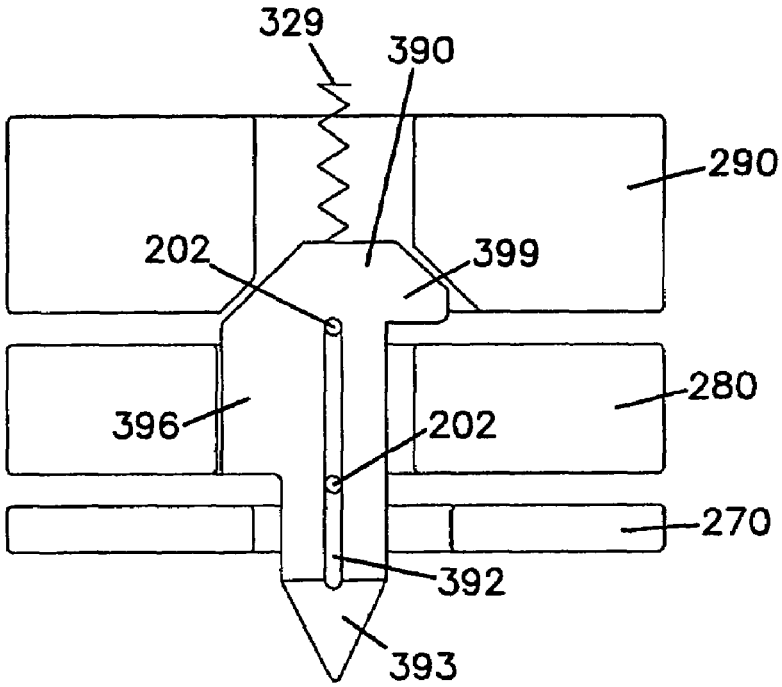
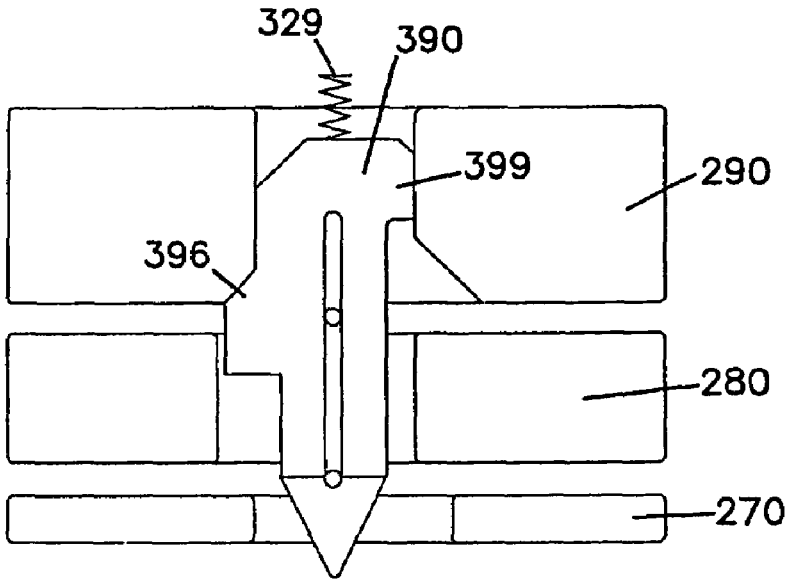
FIG. 9B

WEIGHT SELECTION METHODS AND APPARATUS

CROSS-REFERENCE TO RELATED APPLICATIONS

This is a continuation of U.S. patent application Ser. No. 11/652,950, filed Jan. 12, 2007 (U.S. Pat. No. 7,387,597), which in turn, discloses subject matter entitled to the filing date of U.S. Provisional Application No. 60/759,998, filed Jan. 17, 2006.

FIELD OF THE INVENTION

The present invention relates to exercise equipment and in a preferred application, to methods and apparatus for adjusting weight resistance to exercise activity.

BACKGROUND OF THE INVENTION

Past efforts have led to various inventions directed toward adjustable weight exercise devices. Some examples of such efforts in the field of free weights are disclosed in U.S. Pat. No. 3,771,785 to Speyer; U.S. Pat. No. 4,529,198 to Hettick, Jr.; U.S. Pat. No. 4,822,034 to Shields; U.S. Pat. No. 4,284,463 to Shields; U.S. Pat. No. 5,637,064 to Olson et al.; U.S. Pat. No. 5,769,762 to Towley, III et al.; U.S. Pat. No. 5,839,997 to Roth et al.; U.S. Pat. No. 6,033,350 to Krull; U.S. Pat. No. 6,099,442 to Krull; U.S. Pat. No. 6,322,481 to Krull; and U.S. Pat. No. 6,855,097 to Krull. Despite these advances in the field of weight lifting equipment, room for continued improvement remains with respect to selecting different combinations of weight for exercise purposes.

SUMMARY OF THE INVENTION

The present invention is directed toward methods and apparatus involving the movement of mass subject to gravitational force. In a preferred application, the present invention allows a person to adjust weight resistance by securing desired amounts of mass to a handlebar or other weight lifting member. A preferred embodiment of the present invention may be described in terms of an exercise dumbbell having a handle member that includes a first weight supporting section, a second weight supporting section, and a handle extending therebetween and defining a longitudinal axis. First weights are configured and arranged to occupy the first weight supporting section, and second weights are configured and arranged to occupy the second weight supporting section. A weight selector is movably mounted on the handle member for movement parallel to the longitudinal axis to selectively engage and disengage one of the first weights. A knob is rotatably mounted on the handle member for rotation about an axis extending parallel to the longitudinal axis, and the weight selector is preferably compressed between the knob and a spring. The knob is configured to alternatively push the weight selector in a first direction relative to the handle member, and accommodate movement of the weight selector in an opposite, second direction relative to the handle member, as a function of the knob's orientation relative to the handle member. The resulting change in position of the weight selector alternatively engages and disengages the associated first weight. A similar arrangement is preferably provided on the opposite end of the handle member to selectively engage and disengage one of the second weights. Many features and/or advantages of the present invention will become apparent from the more detailed description that follows.

BRIEF DESCRIPTION OF THE FIGURES

With reference to the Figures, wherein like numerals represent like parts and assemblies throughout the several views.

FIG. 7*a* is a top view of other parts shown in FIG. 5, including three weight plates and a selector for the smallest weight plate;

FIG. 7*b* is another top view of the parts shown in FIG. 5, showing the selector moved to an engagement position relative to the smallest weight plate;

FIG. 8*a* is a top view of other parts shown in FIG. 5, including three weight plates and a selector for the middle weight plate;

FIG. 8*b* is another top view of the parts shown in FIG. 5, showing the selector moved to an engagement position relative to the middle weight plate;

FIG. 9*a* is a top view of other parts shown in FIG. 5, including three weight plates and a selector for the largest weight plate; and FIG. 9*b* is another top view of the parts shown in FIG. 5, showing the selector moved to an engagement position relative to the largest weight plate.

DETAILED DESCRIPTION OF A PREFERRED EMBODIMENT

Figure 1:
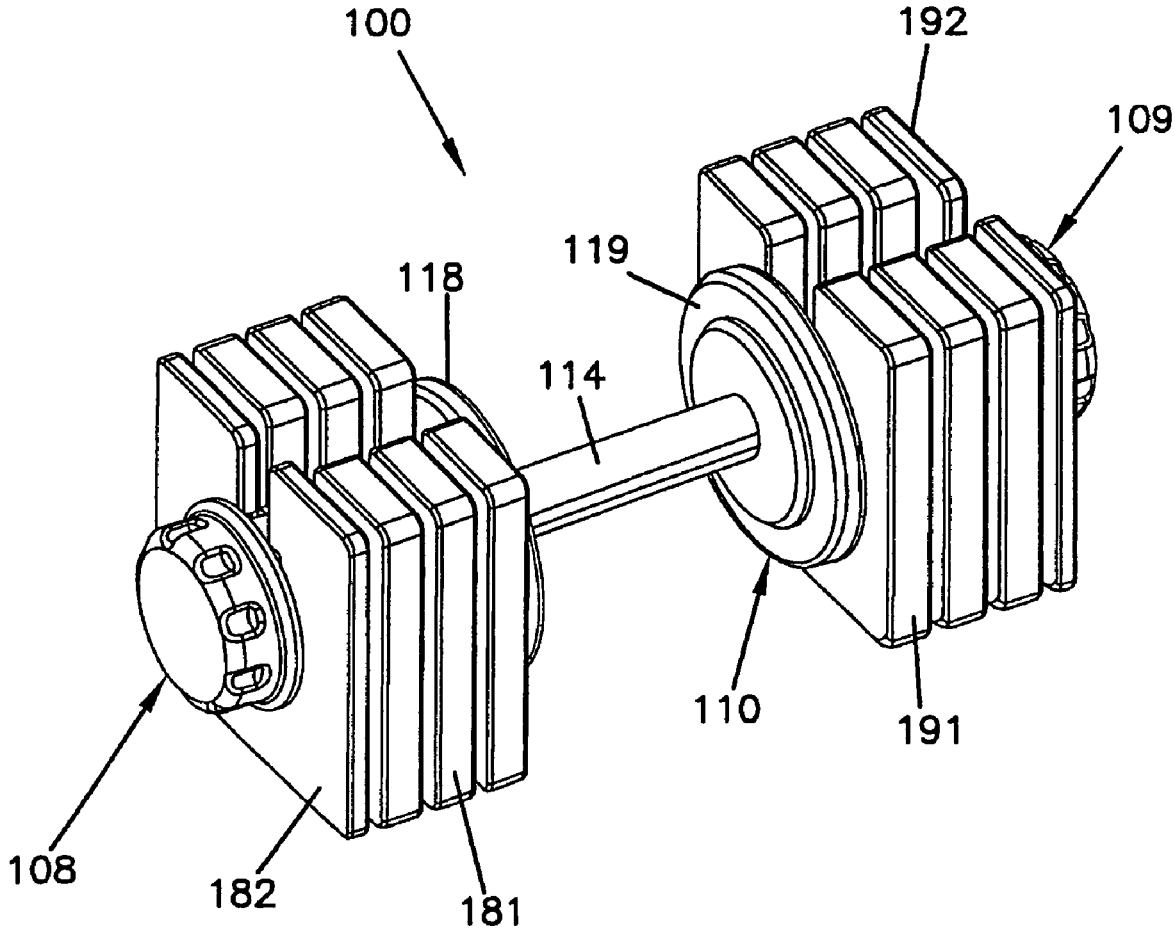
FIG. 1 is a perspective view of an exercise dumbbell constructed according to the principles of the present invention.

FIG. 1 shows an exercise dumbbell 100 constructed according to the principles of the present invention. In many respects, the dumbbell 100 is functionally similar to the dumbbell disclosed in U.S. Pat. No. 5,839,997 to Roth et al., which is incorporated herein by reference to the extent it may help facilitate understanding of the present invention. Like the Roth dumbbell, the dumbbell 100 includes a weight lifting member or handle member 110, a plurality of weight plates 181 and 191 that are selectively secured to the handle member 110, and a base or cradle (not shown) that supports the other components when not in use. In fact, the only functional differences between the Roth dumbbell and the dumbbell 100 are (1) the separation of the selector shaft into two discrete pieces, one at each end of the dumbbell; and (2) the selective engagement of additional weights 182 and 192.

Generally speaking, the handle member 110 includes an intermediate handle or hand grip 114, and first and second weight supporting sections 118 and 119 disposed at opposite ends of the handle 114. The selector shafts (one of which is designated as 112 in FIG. 2) extend through the respective weight supporting sections 118 and 119, and are rigidly secured to respective knobs 108 and 109. On the dumbbell 100, the shafts have cammed segments that are configured to sequentially engage respective weight plates 181 and 191 upon each eighty degrees of rotation in a first direction, and to release respective weight plates 181 and 191 upon each eighty degrees of rotation in an opposite, second direction.

Figure 2:
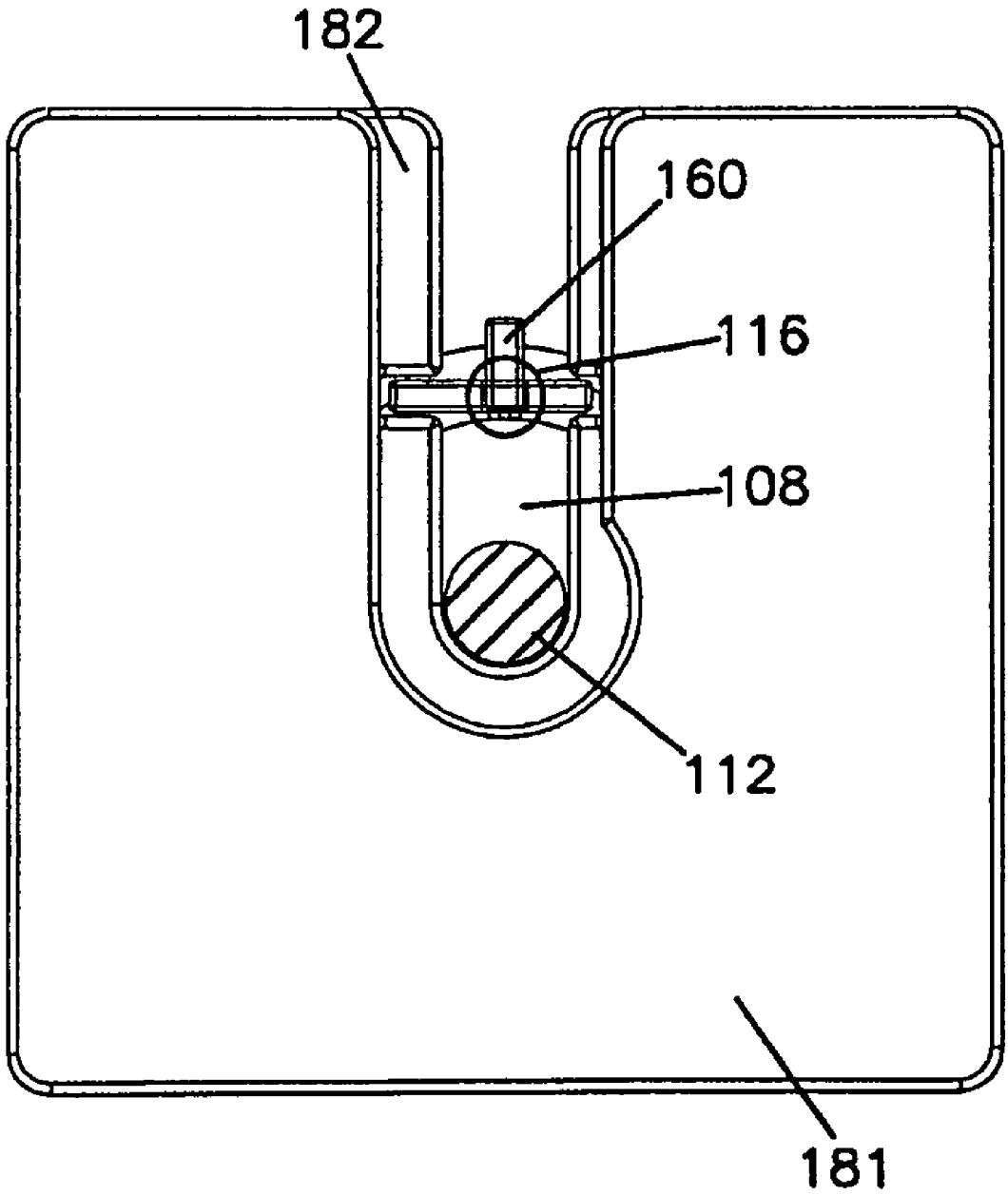
FIG. 2 is a sectioned end view of the dumbbell of FIG. 1.
Figure 3:
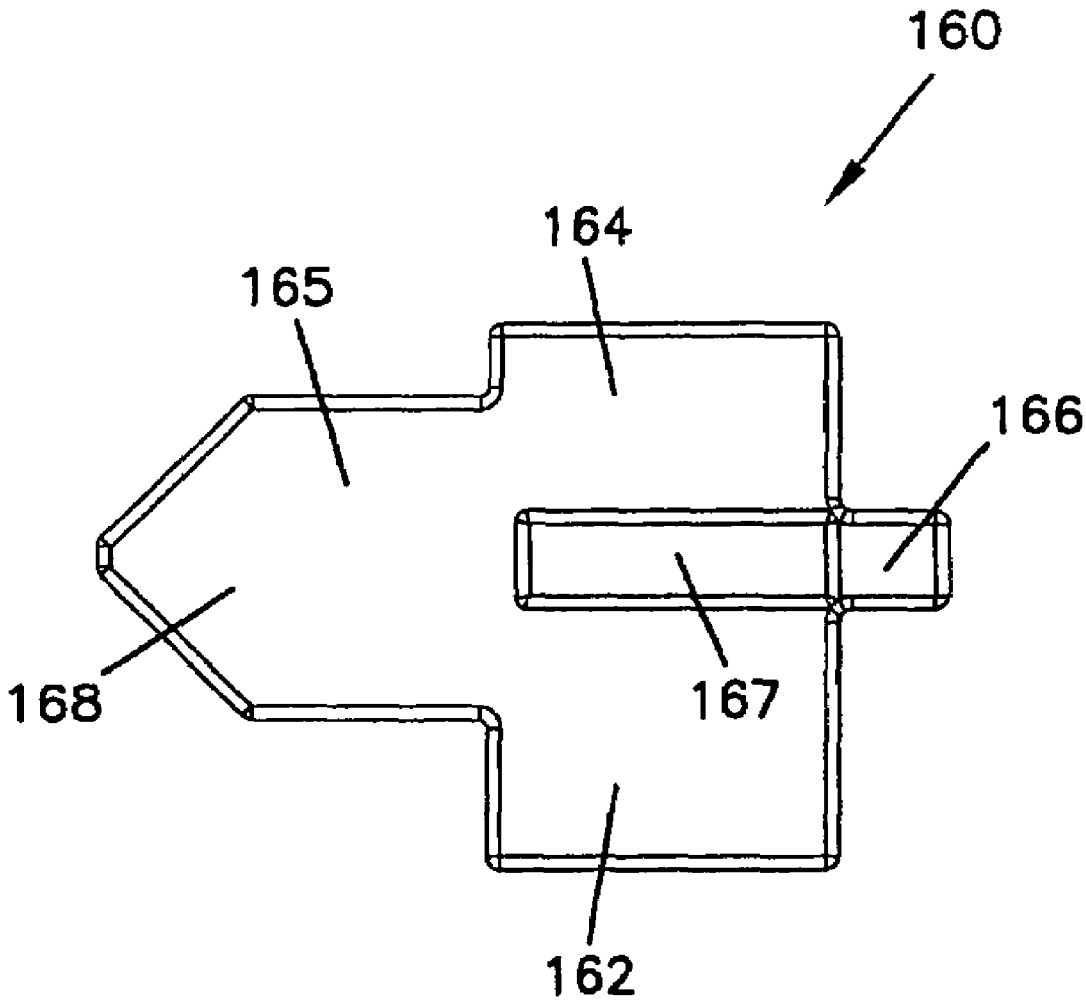
FIG. 3 is a top view of a weight selector that is part of the dumbbell shown in FIG. 1.

Among other things, FIG. 2 shows a weight selector 160 that is movably mounted in the weight supporting section 118 for movement parallel to a longitudinal axis defined by the handle 114. As shown in FIG. 3, the weight selector 160 includes a relatively wider portion that includes laterally extending flanges 162 and 164, and a relatively narrower portion 165 that does not have any such flanges. The narrower portion terminates in a distal end 168 that may be described as pointed or triangular. A rib 167 projects upward from the wider portion and cooperates with a channel (not shown) in the weight supporting section 118 to limit movement of the weight selector to a desired path of motion (parallel to the longitudinal axis of the handle 114). Also, a tab 166 projects outward from an end of the wider portion, opposite the pointed end 168, to support one end of a helical coil spring 116 (shown in FIG. 2). The spring 116 is compressed between the weight selector 160 and the inward end plate (disposed adjacent the handle 114) on the weight supporting section 118.

As shown in FIG. 2, the weight selector 160 has an overall width that is less than the width of the upwardly opening slots in the weight plates 181, thereby accommodating upward movement of the weight selector 160 relative thereto. Also, the narrower portion of the weight selector 160 is narrower than the width of the upwardly opening slot in the weight plate 182, but the wider portion of the weight selector 160 is wider than the width of the upwardly opening slot in the weight plate 182, so lateral notches are provided in the weight plate 182 to accommodate the flanges 162 and 164. The weight selector 160 is movable between a first position, wherein the narrow portion 165 occupies the slot in the weight plate 182 and thus, the weight selector 160 is free to move upward relative to the weight plate 182, and a second position, wherein the flanges 162 and 164 occupy the notches in the weight plate 182 and thus, the weight plate 182 is constrained to move upward together with the weight selector 160.

Figure 4:
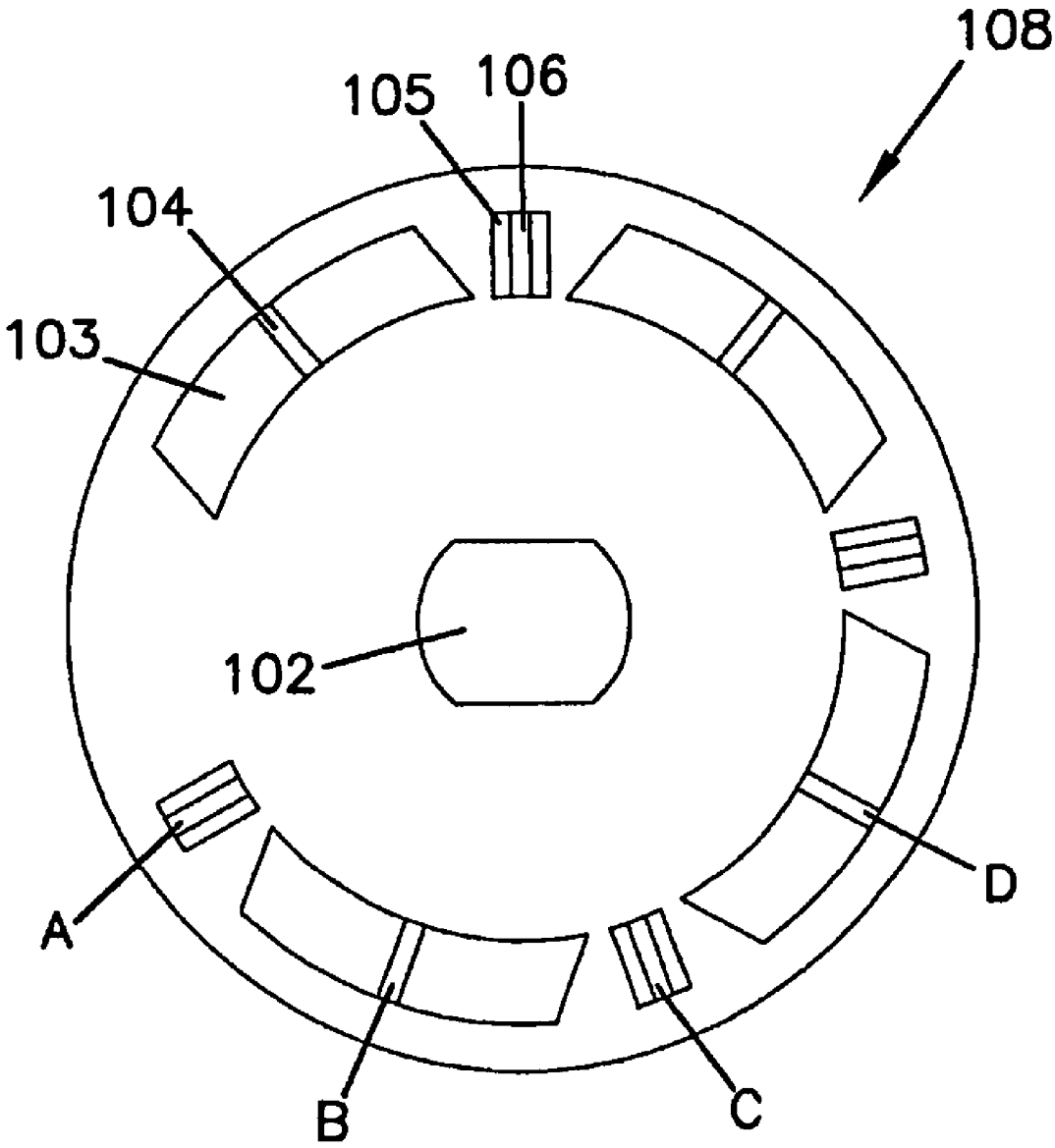
FIG. 4 is an end view of a knob that is part of the dumbbell shown in FIG. 1.

FIG. 4 shows the knob 108 from the same perspective as FIG. 2, but with the other components removed. A cavity 102 is centrally located in the knob 108 to facilitate keyed mounting of the knob 108 onto the bar 112. Also, a series of circumferentially spaced recesses are provided in the knob 108 to define a contoured bearing surface that aligns with the distal end 168 of the weight selector 160. The recesses include relatively long and penetrating inclined surfaces or ramps 103 (with small flats 104 disposed between the relatively deeper ends thereof), and relatively short and shallow inclined surfaces or ramps 105 (with flats 106 disposed between the relatively deeper ends thereof). The flats 104 and 106 are disposed at forty degree intervals apart from one another.

When a flat 106 is rotated into alignment with the weight selector 160, the knob 108 pushes the weight selector 160 into the first position described above (with the narrow portion 165 occupying the slot in the weight plate 182). When a flat 104 is rotated into alignment with the weight selector 160, force exerted by the spring 116 pushes the weight selector 160 into the second position described above (with the flanges 162 and 164 occupying the notches in the weight plate 182).

In FIG. 4, the letter A indicates the location on the knob 108 for the lowermost weight setting. When this sector of the knob 108 is rotated into alignment with the weight selector 160, none of the weights 181 or 182 is engaged to be lifted together with the handle member 110. The letter B indicates the location on the knob 108 for the second lowest weight setting. When this sector of the knob 108 is rotated into alignment with the weight selector 160, the weight 182 is engaged to be lifted (and the weights 181 remain disengaged). The letter C indicates the location on the knob 108 for the third lowest weight setting. When this sector of the knob 108 is rotated into alignment with the weight selector 160, the weight 182 is disengaged, while one of the weights 181 is engaged to be lifted together with the handle member 110 (because a knuckle on the shaft 112 rotates into a laterally extending notch in the associated weight 181). The letter D indicates the location on the knob 108 for the fourth lowest weight setting. When this sector of the knob 108 is rotated into alignment with the weight selector 160, the engaged weight 181 remains engaged, and the weight 182 is re-engaged to be lifted together with the handle member 110. The process continues as two more of the weights 181 are successively engaged, and the weight 182 is alternately engaged and disengaged.

With each of the weights 181 made to weigh 5 pounds, and the weight 182 made to weigh 2.5 pounds, a total of 17.5 pounds may be added to the associated end of the handle member 110 in increments of 2.5 pounds. With a similar arrangement at the opposite end of the handle member 110, weight may be added to the handle member 110 in balanced increments of 5 pounds (and out of balance increments of 2.5 pounds). With the handle member 110 made to weigh 5 pounds, the weight of the dumbbell 100 is adjustable between 5 and 40 pounds. On an alternative embodiment, the two selector shafts 112 are rigidly interconnected to form a single integral shaft (that extends through the handle member). On this embodiment, rotation of either knob 108 or 109 adjusts both end of the dumbbell (and the weight is adjustable only in balanced 5 pound increments).

Figure 5:
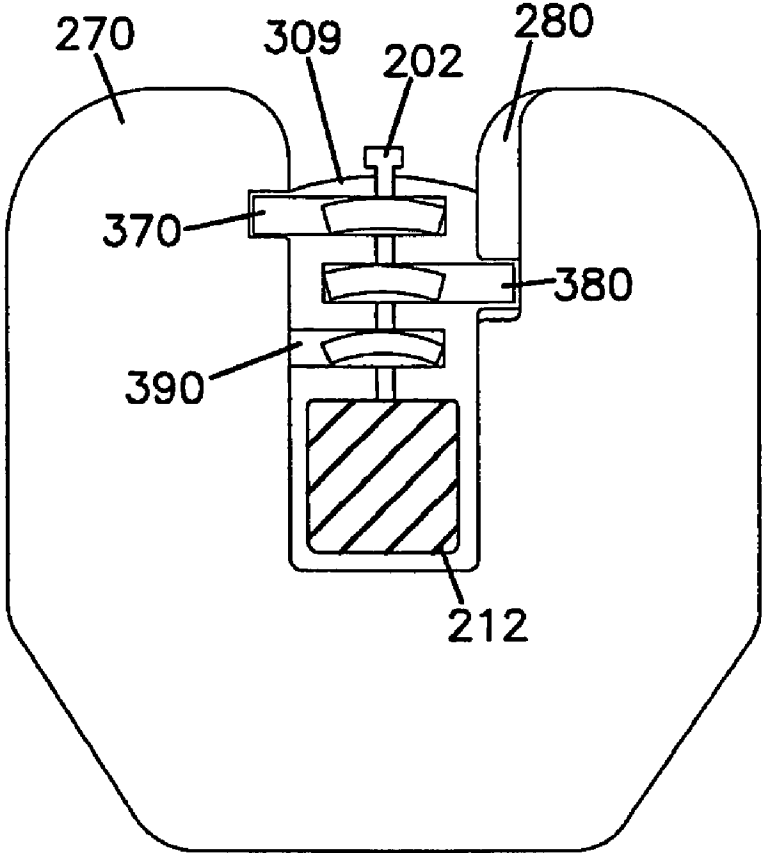
FIG. 5 is a partially sectioned end view of certain parts of an alternative embodiment dumbbell constructed according to the principles of the present invention.

FIG. 5 shows components of an alternative embodiment exercise dumbbell constructed according to the principles of the present invention. The depicted components are shown with most of the handle assembly components removed for ease of illustration (the missing components cooperate to maintain the depicted parts in the relative positions shown in FIG. 5). At each end of this dumbbell, there are three discrete selectors 370, 380, and 390 that operate (in a manner similar to the selectors 160 on the dumbbell 100) to selectively engage three discrete weight plates 270, 280, and 290, respectively. Bolts 212 extend through longitudinally extending slots 372, 382, and 392 in respective selectors 370, 380, and 390, and are threaded into a main bar 212 to slidably connect the selectors 370, 380, and 390 to the bar 212 for sliding parallel to a longitudinal axis defined by the bar 212.

A knob 309 is rotatably mounted on a suitably configured end of the bar 212. In this regard, the end of the bar 212 is rounded to fit into a central bore 312 in the knob 309, and a bolt (not shown) is inserted through a central hole 310 in the knob 309 and threaded into the bar 212. The bolt is configured to tighten firmly in place relative to the bar 212 with just enough of a gap defined between the bar 212 and the head of the bolt to accommodate easy rotation of the knob 309 relative thereto. A stand-off section on the bolt and/or thrust washers may be used to ensure smooth rotation of the knob 309.

Figure 6:
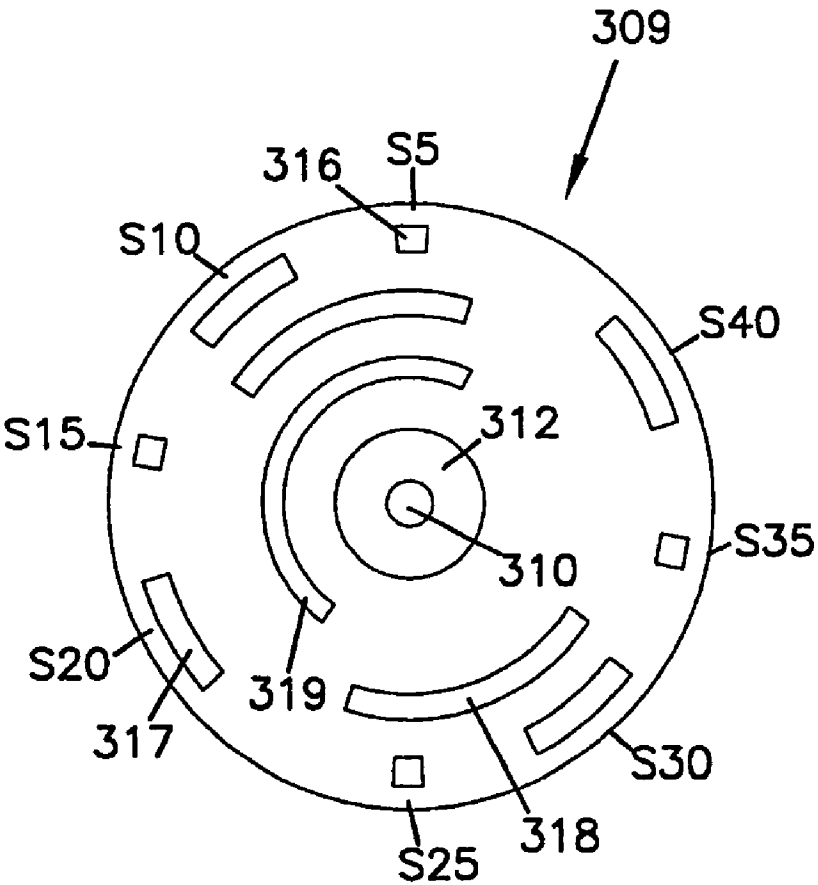
FIG. 6 is an end view of a knob that is among the parts shown in FIG. 5.

As shown in FIG. 6, the inward facing side of the knob 309 is provided with three concentrically aligned, circumferential bearing surfaces. The radially outermost bearing surface is comprised of small, relatively shallow depressions 316, relatively larger and deeper depressions 317, and flats disposed therebetween. The centers of the depressions 316 and 317 associated with designated knob sectors S5-S20 are disposed at forty degree angles relative one another; the centers of the depressions 316 and 317 associated with designated knob sectors S25-S40 are similarly disposed at forty degree angles relative to one another; and the centers of the depressions 316 associated with designated knob sectors S5 and S25 are disposed at an angle of one hundred eighty degrees relative to one another.

The radially intermediate bearing surface is comprised of relatively longer depressions 318 (which are comparable in depth to the depressions 317) and relatively longer flats disposed therebetween. The center of the depression 318 associated with designated knob sectors S5-S10 is disposed twenty degrees counter-clockwise relative to the center of the depression 316 associated with the knob sector S5; and the centers of the two depressions 318 are disposed at an angle of one hundred eighty degrees relative to one another. The radially innermost bearing surface is comprised of a relatively longer and deeper depression 319 and a relatively longer, diametrically opposed flat. The center of the depression 319 is disposed sixty degrees counter-clockwise relative to the center of the depression 316 associated with the knob sector S5.

FIGS. 7*a*-7*b* show the uppermost weight selector 370 relative to the weight plates 370, 380, and 390. As noted above, a slot 372 extends through the selector 370 to accommodate bolts 202, and to accommodate travel of the selector 370 relative thereto. The selector 370 has a first end or tip 373 that may be described as pointed or triangular, and an opposite, second end that bears against one end of a helical coil spring 327. An opposite end of the spring 327 bears against an inner end plate (not shown) on the handle assembly. Also, a tab 377 projects laterally outward from the selector 370.

The tip 373 of the selector 370 is configured and arranged to align with and bear against the radially outermost bearing surface on the knob 309. As shown in FIG. 5, the tip 373 has an arcuate profile that is centered about the longitudinal axis of the bar 212 (and that matches the curvature of the depressions 317). FIG. 7*a* shows the position occupied by the selector 370 when the tip 373 occupies any one of the small depressions 316 in the knob 309 (disposed in sectors S5, S15, S25, and S35). When the selector 370 occupies this position, the tab 377 is clear of the weight plate 270 and free to move upward relative thereto. FIG. 7*a* also shows that the weight plate 280 is configured to accommodate the tab 377 without being engaged for upward movement together therewith.

FIG. 7*b* shows the position occupied by the selector 370 when the tip 373 occupies any one of the larger depressions 317 in the knob 309 (disposed in sectors S10, S20, S30, and S40). When the selector 370 occupies this position, the tab 377 occupies a laterally opening notch (see FIG. 5) in the weight plate 270, thereby constraining the weight plate 270 to move upward together therewith.

The spring 327 biases the selector 370 against the knob 309 and into a respective depression 316 or 317 (when aligned relative thereto). The depressions 316 and 317 are relatively deep in the middle and relatively shallow at the ends, thereby encouraging the tip 373 to center itself within a respective depression 316 or 317, and also providing angled bearing surfaces to urge the tip 373 out of the respective depression 316 or 317 in response to rotation of the knob 309 in either direction.

FIGS. 8*a*-8*b* show the intermediate weight selector 380 relative to the weight plates 370, 380, and 390. As noted above, a slot 382 extends through the selector 380 to accommodate bolts 202, and to accommodate travel of the selector 380 relative thereto. The selector 380 has a first end or tip 383 that may be described as pointed or triangular, and an opposite, second end that bears against one end of a helical coil spring 328. An opposite end of the spring 328 bears against an inner end plate (not shown) on the handle assembly. Also, a tab 388 projects laterally outward from the selector 380.

The tip 383 of the selector 380 is configured and arranged to align with and bear against the radially intermediate bearing surface on the knob 309. As shown in FIG. 5, the tip 383 has an arcuate profile that is centered about the longitudinal axis of the bar 212 (and that matches the curvature of the depressions 318). FIG. 8*a* shows the position occupied by the selector 380 when the tip 383 occupies either of the depressions 318 in the knob 309 (disposed in sectors S5-S10 and S25-S30). When the selector 380 occupies this position, the tab 388 is clear of the weight plate 280 and free to move upward relative thereto. FIG. 8*a* also shows that the weight plate 270 is configured to accommodate the tab 388 without being engaged for upward movement together therewith.

FIG. 8*b* shows the position occupied by the selector 380 when the tip 383 bears against any flat portion of the knob 309 (disposed in sectors S15-S20 and S35-S40). When the selector 380 occupies this position, the tab 388 occupies a laterally opening notch (see FIG. 5) in the weight plate 280, thereby constraining the weight plate 280 to move upward together therewith.

The spring 328 biases the selector 380 against the knob 309 and into a respective depression 318 (when aligned relative thereto). The depressions 318 are relatively deep in the middle and relatively shallow at the ends, thereby providing angled bearing surfaces to urge the tip 383 out of the respective depression 319 in response to rotation of the knob 309 in either direction. The depressions 318 are preferably flat in the middle, so the selector 380 does not move significantly during movement between sectors S5 and S10, nor during movement between sectors S25 and S30.

FIGS. 9*a*-9*b* show the lowermost weight selector 390 relative to the weight plates 370, 380, and 390. As noted above, a slot 392 extends through the selector 390 to accommodate bolts 202, and to accommodate travel of the selector 390 relative thereto. The selector 390 has a first end or tip 393 that may be described as pointed or triangular, and an opposite, second end that bears against one end of a helical coil spring 329. An opposite end of the spring 329 bears against an inner end plate (not shown) on the handle assembly. Also, tabs 396 and 399 project laterally outward from respective sides of the selector 390.

The tip 393 of the selector 390 is configured and arranged to align with and bear against the radially inwardmost bearing surface on the knob 309. As shown in FIG. 5, the tip 393 has an arcuate profile that is centered about the longitudinal axis of the bar 212 (and that matches the curvature of the depression 319). FIG. 9*a* shows the position occupied by the selector 390 when the tip 393 occupies the depression 319 in the knob 309 (disposed in sectors S5-S20). When the selector 390 occupies this position, the tabs 396 and 399 are clear of the weight plate 290 and free to move upward relative thereto. FIG. 9*a* also shows that the weight plate 280 is configured to accommodate the tab 396 without being engaged for upward movement together therewith (and that a portion of the weight plate 290 is configured to accommodate the shorter tab 399 without being engaged for upward movement together therewith).

FIG. 9*b* shows the position occupied by the selector 390 when the tip 393 bears against any flat portion of the knob 3*b*9 (disposed in sectors S25-S40). When the selector 390 occupies this position, the tabs 396 and 399 occupy respective, laterally opening notches in the weight plate 290 (similar in cross-section to the notches shown in the weight plates 270 and 280), thereby constraining the weight plate 290 to move upward together therewith.

The spring 329 biases the selector 390 against the knob 309 and into the depression 319 (when aligned relative thereto). The depression 319 is relatively deep in the middle and relatively shallow at the ends, thereby providing angled bearing surfaces to urge the tip 393 out of the respective depression 319 in response to rotation of the knob 309 in either direction.

The depression 319 is relatively deeper than the depressions 317 and 318 to encourage additional longitudinal travel of the selector 390, and it is preferably flat in the middle, so the selector 390 does not move significantly during movement among sectors S5-S20.

A respective knob 309 at each end of the dumbbell is rotated relative to the bar 212 to place the contoured bearing surfaces in alignment with respective selector tips 373, 383, and 393. When the S5 sectors are positioned at 12:00 relative to the bar 212, the selectors 370, 380, and 390 are held in the positions shown in FIGS. 7*a*, 8*a*, and 9*a*, respectively. With the handle assembly made to weigh 5 pounds, this position of the knobs 309 sets the current dumbbell weight at 5 pounds (because none of the weight plates 270, 280, and 290 are engaged for upward movement together therewith).

With the weight plates 270 made to weigh 2.5 pounds each, and the S10 sectors positioned at 12:00 relative to the bar 212, the current dumbbell weight becomes 10 pounds (because the weight plates 270 are now engaged for upward movement together with the handle assembly). With the weight plates 280 made to weigh 5 pounds each, and the S15 sectors positioned at 12:00 relative to the bar 212, the current dumbbell weight becomes 15 pounds (because the weight plates 280 are now engaged for upward movement together with the handle assembly). With the weight plates 290 made to weigh 10 pounds each, and the S25 sectors positioned at 12:00 relative to the bar 212, the current dumbbell weight becomes 25 pounds (because the weight plates 290 are now engaged for upward movement together with the handle assembly). In all, the dumbbell is adjustable from 5 to 40 pounds in balanced increments of 5 pounds, and out of balance increments of 2.5 pounds. Indicia may be provided on the knobs 309 to indicate the weight of the dumbbell as a function of the orientation of the knobs 309. The amounts indicated at the two ends are preferably averaged to determine the current selected weight.

On an alternative embodiment, the main bar 212 is replaced by a main tube, and a rod is rotatably mounted inside the tube and rigidly connected to both knobs. An advantage of this arrangement is that either knob may be rotated to simultaneously adjust the weight at both ends of the dumbbell. Another advantage of this arrangement is that a single locking mechanism may be applied to the rod or either knob for purposes of preventing unintended rotation of the knobs. An example of a suitable locking mechanism is disclosed in U.S. Pat. No. 6,540,650 to Krull, which is incorporated herein by reference. On the other hand, a disadvantage of this arrangement is that the dumbbell is no longer adjustable in out-of-balance increments of 2.5 pounds.

The subject invention has been described with reference to particular embodiments with an emphasis on the novel aspects of the subject invention. Among other things, various arrangements may be used to maintain proper alignment of the weight plates both on the handle member and when not in use. Some such arrangements are disclosed in the patents identified in the Background of the Invention, which are incorporated herein by reference to the extent they may help facilitate understanding of the subject invention. Persons skilled in the art will also recognize that features of the various embodiments may be mixed and matched as deemed necessary and/or desirable.

The present invention may also be described in terms of various methods relative to the apparatus disclosed herein. For example, the present invention may be described in terms of a method of adjusting resistance to exercise, including the steps of providing a lifting member having at least one weight holder; providing weights sized and configured to occupy the at least one weight holder; mounting a weight selector on the lifting member for movement along a path between a first position, underlying one of the weights, and a second position, free to move upward relative to said one of the weights; and mounting a knob on the handle member for rotation about an axis extending parallel to the path, with a contoured surface on the knob that bears against the weight selector in a manner that alternatively holds the weight selector in the first position and the second position as a function of orientation of the knob relative to the handle member.

In a more general sense, the present invention may be described in terms of an exercise device, comprising: a weight lifting member; weights sized and configured to align with the weight lifting member; a weight selector movably mounted on the weight lifting member for movement between a first position, underlying one of the weights, and a second position, free to move upward relative to said one of the weights; and a knob rotatably mounted on the weight lifting member for rotation about a knob axis, wherein a contoured bearing surface on the knob bears against the weight selector to alternatively hold the weight selector in the first position and the second position as a function of orientation of the knob relative to the weight lifting member.

This disclosure will enable persons skilled in the art to derive additional modifications, improvements, and/or applications that nonetheless embody the essence of the invention. For example, it may be desirable to replace the coil springs with leaf springs or foam rubber. Also, it may be desirable to eliminate the springs altogether and instead, provide "two-sided bearing surfaces" on the knobs to both push and pull the selectors in response to rotation. Moreover, similar weight selecting arrangements may be provided on weight stack machines, especially in connection with the selection of supplemental weights that weigh a fraction of each weight plate in the primary stack. In view of the foregoing, the scope of the present invention should be limited only to the extent of the following claims.

What is claimed is:

1. An exercise device, comprising:

a weight lifting member;

weights sized and configured to align with the weight lifting member;

a weight selector movably mounted on the weight lifting member for movement between a first position, underlying one of the weights, and a second position, free to move upward relative to said one of the weights; and a knob rotatably mounted on the weight lifting member for rotation about a knob axis from a first orientation, wherein a first portion of the knob engages an end portion of the weight selector in a manner that holds the weight selector in the first position, and a second orientation, wherein a discrete, second portion of the knob engages said end portion of the weight selector in a manner that holds the weight selector in the second position.

2. An exercise device, comprising:

a weight lifting member:

weights sized and configured to align with the weight lifting member;

a first weight selector movably mounted on the weight lifting member for movement between a first position, underlying one of the weights, and a second position, free to move upward relative to said one of the weights;

a second weight selector movably mounted on the weight lifting member for movement between a first position, underlying a second one of the weights, and a second position, free to move upward relative to said second one of the weights; and a knob rotatably mounted on the weight lifting member for rotation about a knob axis from a first orientation, wherein a first portion of the knob holds the weight selector in its first position, and a second orientation, wherein a discrete, second portion of the knob holds the weight selector in its second position, wherein a discrete, third portion of the knob holds the second weight selector in its first position when the knob occupies the first orientation, and a discrete, fourth portion of the knob holds the second weight selector in its second position when the knob is rotated to a discrete, third orientation.

3. The exercise device of claim 2, wherein the first portion and the second portion are disposed at a first common radius from the knob axis, and the third portion and the fourth portion are disposed at a discrete, second common radius from the knob axis.

4. The exercise device of claim 1, further comprising a spring, wherein the spring is squeezed between the weight lifting member and the weight selector, and the weight selector is squeezed between the spring and the knob.

5. The exercise device of claim 1, wherein a weight engaging portion of the weight selector is configured and arranged to occupy an upwardly opening slot in another one of the weights when in the second position, thereby overlying said another one of the weights without underlying said another one of the weights.

6. The exercise device of claim 1, further comprising a separate means for selectively securing a discrete subset of the weights to the weight lifting member in response to rotation of the knob.

7. The exercise device of claim 1, wherein the weight lifting member includes a handle, and a first subset of the weights is disposed at a first end of the handle, and a complementary, second subset of the weights is disposed at an opposite, second end of the handle.

8. The exercise device of claim 7, wherein the handle defines a longitudinal axis that extends parallel to the knob axis.

9. The exercise device of claim 7, wherein the knob is rotatably mounted on a first end of the weight lifting member, and all of the weights in the first subset are disposed between the knob and the handle.

10. The exercise device of claim 9, wherein a second said knob is rotatably mounted on an opposite, second end of the weight lifting member.

11. An exercise device, comprising:

a weight lifting member;

weights sized and configured to align with the weight lifting member;

a weight selector movably mounted on the weight lifting member for movement between a first position, underlying one of the weights, and a second position, free to move upward relative to said one of the weights;

a spring compressed between the weight selector and the weight lifting member, wherein the spring pushes the weight selector toward one of said first position and said second position, and resists movement of the weight selector toward an opposite one of said first position and said second position; and a knob rotatably mounted on the weight lifting member and bearing against a portion of the weight selector opposite the spring, wherein the knob and the spring cooperate to move the weight selector between the first position and the second position in response to rotation of the knob.

12. The exercise device of claim 11, further comprising a second weight selector movably mounted on the weight lifting member for movement between a first position, underlying a second one of the weights, and a second position, free to move upward relative to said second one of the weights; and a second spring compressed between the weight lifting member and the second weight selector, wherein the knob and the second spring cooperate to move the weight selector between its first position and its second position in response to rotation of the knob.

13. The exercise dumbbell of claim 12, wherein the knob rotates about a knob axis, and the first weight selector engages the knob at a first radius from the knob axis, and the second weight selector engages the knob at a discrete, second radius from the knob axis.

14. The exercise dumbbell of claim 11, wherein a weight engaging portion of the weight selector is configured and arranged to occupy an upwardly opening slot in another of the weights when in the second position.

15. The exercise dumbbell of claim 11, further comprising a separate means for selectively securing a discrete subset of the weights to the weight litting member in response to rotation of the knob.

16. The exercise device of claim 11, wherein the weight lifting member includes a handle, and a first subset of the weights is disposed at a first end of the handle, and a complementary, second subset of the weights is disposed at an opposite, second end of the handle.

17. The exercise device of claim 16, wherein the handle defines a longitudinal axis, and the knob rotates about a knob axis that extends parallel to the longitudinal axis.

18. The exercise device of claim 16, wherein the knob is rotatably mounted on a first end of the weight lifting member.

19. The exercise device of claim 18, wherein a second said knob is rotatably mounted on an opposite, second end of the weight lifting member.

* * * * *